US005280006A

United States Patent [19]

Beck et al.

[11] Patent Number: 5,280,006

[45] Date of Patent: Jan. 18, 1994

[54] THERMAL TRANSFER PRINTING RECEIVER

[75] Inventors: Nicholas C. Beck, Manningtree; John A. Pope, Colchester, both of England

[73] Assignee: Imperial Chemical Industries PLC, London, England

[21] Appl. No.: 972,207

[22] Filed: Nov. 5, 1992

[30] Foreign Application Priority Data

Nov. 5, 1991 [GB] United Kingdom ..... 9123466

[51] Int. Cl.[5] ..... B41M 5/035; B41M 5/38

[52] U.S. Cl. ..... 503/227; 428/195; 428/524; 428/913; 428/914

[58] Field of Search ..... 503/227; 8/471; 428/195, 524, 913, 914

[56] References Cited

U.S. PATENT DOCUMENTS 4,737,485 4/1988 Henzel et al. ..... 503/227

*Primary Examiner*—Pamela R. Schwartz

*Attorney, Agent, or Firm*—Cushman, Darby & Cushman

[57] ABSTRACT

A receiver sheet for thermal transfer printing comprises a substrate having a dye-receiving side and a backcoat on the other side, characterised in that the major component of the backcoat is a partially esterified styrene/-maleic anhydride copolymer. This provides a surface which can readily be written on using aqueous inks or ball pens, and can be adhered to by water-activated adhesives. It is also resistant to retransfer of dye from an underlying print, e.g. during storage. The backcoat may also contain antistatic agents and fine inert particles to improve handling properties, appearance and tooth.

9 Claims, No Drawings

THERMAL TRANSFER PRINTING RECEIVER

The invention relates to thermal transfer printing, and especially to receivers having writable backcoats.

Thermal transfer printing is a generic term for processes in which one or more thermally transferable dyes are caused to transfer from a dyesheet to a receiver in response to thermal stimuli. Using a dyesheet comprising a thin substrate supporting a dyecoat containing one or more such dyes uniformly spread over an entire printing area of the dyesheet, printing can be effected by heating selected discrete areas of the dyesheet while the dyecoat is pressed against a receiver sheet, thereby causing dye to transfer to corresponding areas of that receiver. The shape of the pattern transferred is determined by the number and location of the discrete areas which are subjected to heating. Full colour prints can be produced by printing with different coloured dyecoats sequentially in like manner, and the different coloured dyecoats are usually provided as discrete uniform print-size areas in a repeated sequence along the same dyesheet.

High resolution photograph-like prints can be produced by dye-diffusion thermal transfer printing using appropriate printing equipment, such as a programmable thermal print head or laser printer, controlled by electronic signals derived from a video, computer, electronic still camera, or similar signal generating apparatus. A typical high speed thermal print head has a row of individually operable tiny heaters spaced to print six or more pixels per millimeter, using very short hot pulses, e.g. from near zero up to about 10 or 15 ms long, with each pixel temperature typically rising to about 350° C. or more during the longest pulses. Similarly, in a laser printer a modulated laser beam is directed onto each pixel in turn to transfer variable amounts of dye according to the image signal applied to the printer, again to build up a photograph-like image on the receiver sheet.

Receiver sheets comprise a substrate with a dye-receiving side, and sometimes a polymeric backcoat on the other side. For substrates which are themselves dye-receptive polymers, the dye-receiving surface may simply be an area of substrate with a particularly smooth surface texture, but in most cases the substrate supports a receiver coat of a dye-receptive composition. Typical substrates include, for example, cellulose fiber paper (generally coated with a smoothing polymer coating), thermoplastic films such as biaxially orientated polyethyleneterephthalate film, filled and/or voided plastic films such as pearl film, and synthetic papers of multilayer micro-voided polymer films.

The photograph-like images that can be obtained with thermal transfer printing, open up many of the photography markets to the versatile techniques of electronic imaging. Thus immediate printing capability, for example, is useful for instant photograph booths, recording criminal or scientific evidence, or other occasional small quantity uses. Displays and holiday postcards can also take advantage of the ability to mix signals in electronic imaging, enabling portraits to be superimposed on prerecorded backgrounds, for example. However, for all these applications, and many others, the nature of the back of many current receiver sheets can be infuriating to the user, in their inability to accept aqueous-based inks and adhesives. Passport photographs on such materials cannot satisfactorily be endorsed on the back using many common inks, for example, and if one does find other means to enscribe a greetings card, the postage stamp will still not stick to it. Such problems can occur with many previously known receiver sheets, whether the substrate surface be exposed or whether it be coated with a backcoat, and where good writability has previously been achieved, this has often been at the expense of secondary problems, such as retransfer and smudging.

We have now found that such problems can be much reduced by providing the receiver sheet with a backcoat having a selected composition as hereinafter described and claimed.

According to the present invention, a receiver sheet for thermal transfer printing comprises a substrate having a dye-receiving side and a backcoat on the other side, wherein the major component of the backcoat is a partially esterified styrene/maleic anhydride copolymer.

Partially esterified styrene/maleic anhydride copolymers have the general formula below.

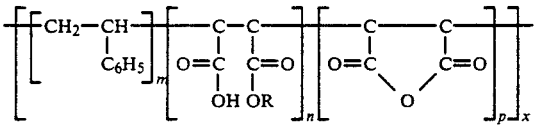

In commercial products these esters are variously referred to as "esterified" or "partially esterified", but however described in the commercial literature, it is copolymers having free carboxylic acid groups, i.e. when n is not zero in the formula above, which are applicable to the present invention. Typical esterification of commercial partial esters is quoted as 30–50%, and materials for which p lies within the range 0-n, can be used, the lower p values being preferred.

We generally prefer to use low molecular weight copolymers, as these are readily soluble in both aqueous (e.g. ammoniacal or containing other volatile amines such as morpholine) and the more polar of the organic solvents, such as methanol, acetone and diacetone alcohol (D.A.A), or mixtures thereof. Average molecular weights within the range 1,000 to 200,000, are particularly convenient. As will be shown in the Examples hereinafter, the aqueous compositions can be made more viscous to enable them to be coated using high speed coating techniques, such as slot fed reverse meter or reverse gravure.

Examples of such copolymers include the range of partially esterified copolymers marketed by Sartomer Company, under the name "SMA Resins". Their commercial literature quotes the following values for the variables in the general formula as $m=1-3$, $n=1$, and $x=6-8$. Other such copolymers are marketed by Monsanto Chemical Company, as "Scripset Resins", and their literature refers to them as esters, having a styrene:maleic ratio $>1:1$, and average molecular weights ranging from 105,000 to 180,000, according to the series selected, the molecular weight distributions being broad. We have found both these proprietary brands to be very effective when used in the receivers of the present invention.

In general, the styrene:maleic ratio, m:n, appears not to be critical. All commercially available partial ester copolymers that we have tested had m:n values in the range 1:1 to 4:1 and all gave good results; and lower and higher values would also be expected similarly to function well.

When used on its own, we find that the copolymer gives a rather brittle backcoat, and generally prefer that it be blended with a minor amount of a plasticising resin containing free hydroxyl or carboxylic acid groups. Suitable plasticising resins need to be soluble in a common solvent with the copolymer, and this criteria may be met by polymers having an abundance of free carboxylic acid groups, e.g. acrylic acid polymers, and other hydroxyl-containing polymers such as polyvinyl alcohol, polyethylene glycols, polypropylene glycols, and similar water soluble polymers.

The amount of plasticising resin that can be added depends on how hydrophilic it is; too much and the composition becomes too susceptible to damage by water. Thus we generally prefer to limit the amount of plasticising resin to the range 5–20% by weight of the backcoat. Examples of suitable plasticising polymers include Carboset 525, a copolymer of ethyl acrylate and acrylic acid containing only about 10% by weight of the latter, marketed by BF Goodrich.

We prefer to add white matting fillers in amounts of about 5 to 50% by weight of the backcoat. These are micronised particulate materials having sizes of about a micron or less, and examples include micronised titanium dioxide, barium sulphate and other minerals, and suitable micronised organic materials include for example Pergopak M3 (micronised urea formaldehyde polymer) manufactured by Martinswerk. The amount of mattness can be controlled by the amount of filler used; thus 50% produces a very flat matt finish, while only 10% gives more of a silky lustre. Most generally useful range is from 12–24%, around 15% being a good general purpose amount.

To provide a surface that can be written on by pencil more effectively, we prefer the backcoat to contain 0.5 to 2% by weight of the backcoat, of inert particles within the size range 2 to 10 μm in diameter. Examples include Syloid 244, sold by Grace, with particles typically 2 μm in diameter. Without such fillers to give roughness, only very soft pencils are effective, although only relatively small proportions of the larger particles need be added. We prefer to use these larger particles in amounts of 0.5 to 2% by weight of the backcoat: less gives too little tooth for effective pencil work, while too much can give an abrasive surface that may lead to undue wear of the writing instrument, or indeed cause scratching of adjacent prints on storage.

Particularly preferred is a backcoat containing both inert particles within the size range 2 to 10 μm in diameter and micronised particulate fillers, the ratio of said inert fillers to said the micronised fillers being in the range 1:5 to 1:17, although ratios outside that range can be used to obtain particular effects.

Smudging can be a problem on some known backcoats when using a variety of inks, e.g. common aqueous writing inks and ball point pens. Thus when a line is drawn on the back of a print and the ink allowed a short time to dry (we allow 30 s in the tests hereinafter), should a finger be drawn across the line, there is often a tendency for the line to smudge, even when a good smooth line has initially been drawn. We find that backcoat compositions within the invention, especially compositions having higher filler loadings with the above ranges, can have relatively good smudge resistance.

Fillers and aggregates in the backcoat, especially the larger fillers, can make precise measurement of the backcoat thickness more difficult. Thus a coat thickness when estimated as a weight from the coating solution consumption rate, may tend to give a lower thickness than that measured directly. Whatever the true values, some problems may arise with too thin a backcoat. While we have obtained good writability with thicknesses as low as 1 to 2 μm, for general all round properties, we prefer a coating thickness within a range of about 3 to 25 μm, especially about 5 to 15 μm. A too thin coating weight can lead to scratching when using high filler loadings, and to larger filler particles coming loose with further consequent damage.

The above benefits of good writability with low smudging can be obtained without resorting to crosslinking of the backcoat, but we do generally prefer to do so to obtain the extra stability that crosslinking provides, during both printing and subsequent use. Thus our preferred backcoat comprises a crosslinked polymer matrix being the reaction product of a polyfunctional crosslinking agent reactive with free hydroxyl and carboxylic acid groups in the presence of organic strong acid, with as co-reactant at least the copolymer, and (if present) preferably also the plasticising resin, said co-reactant being in excess. Being in excess enables the copolymer to retain some of the free carboxylic acid groups which contribute to the properties to which this invention is directed. Examples of organic strong acids suitable for such crosslinking reactions include p-toluene-sulphonic acid (PTSA) and phthalic acid.

Suitable such crosslinking agents include polyfunctional N-(alkoxymethyl)amino resins, such as alkoxymethyl derivatives of urea, guanamine and melamine resins. Various lower alkyl compounds (i.e. up to the $C_4$ butoxy derivatives) are available commercially and all can be used effectively, but the methoxy derivative is much preferred because of the greater ease with which its more volatile by-product (methanol) can be removed afterwards. Examples of the latter include hexamethoxymethylmelamines, suitably used in a partially prepolymerised (oligomer) form to obtain appropriate viscosities, such as Cymel 303, sold by American Cyanamid. Cymel 1171, a highly alkylated glycoluril resin, will also react with the copolymers in the presence of a strong organic acid like PTSA. Other suitable cross linking agents include Beetle BE692 and Beetle BE659, which are butylated benzoguanamine and butylated melamine formaldehyde resins respectively, from BIP Chemicals.

Whether crosslinked or not, we find the present invention can provide backcoats of high stampability, in that postage stamps can readily be adhered to the backcoat.

In addition to providing an effectively writable and stampable backcoat, we have found that we have also obtained a number of further unexpected advantages. We have found that stacks of prints made on receivers of the present invention, can be safely stored, even in quite humid conditions, for substantial periods, with lower levels of retransfer, i.e. migration of dyes from the print to an overlying backcoat, than has previously been achievable with at least most known backcoats.

Dye diffusion thermal transfer relies on dyes being sufficiently mobile to diffuse from one polymer environment into another when heat is applied by the printer. Like the receiver layer, backcoats are generally polymer-based, and when they are held in contact with dye-containing prints for extended periods, e.g. during storage, some retransfer of the dye may occur, with dye molecules diffusing from the print into the backcoat, even at the relatively low temperatures of ambient conditions. This is an unwanted side effect commonly observed when thermal transfer prints are stored in contact with each other, e.g. in an envelope, paper wallet or box.

Another advantage we have observed being provided by the present compositions is their ability to adhere to difficult substrates. Some receivers contain polyolefinic surface materials to which good adhesion of coatings is difficult, and various treatments, such as corona discharge treatment, are generally employed to enable an acceptable level of adhesion to be attained. Examples of such substrates include Yupo synthetic papers comprising a voided film coated with microvoided polypropylene blends, pearlfilm which is a filled and voided polypropylene composition, and paper receivers coated with polyolefin blends free of microvoids. We have consistently obtained good adhesion between the present backcoats and such polyolefin containing materials.

A further advantage that the present backcoats have over most known backcoats is their ability generally to use water as solvent in the coating compositions, rather than the less environmentally friendly organic solvents normally required.

The receiver sheets of the present invention enable the user to take advantage of the versatility of electronic imaging in many of the applications referred to in the introduction hereto, wherein the dye-receiving side is provided with a thermally transferred image, such as a photograph-like image or computer generated graphic, for example, and the present backcoat enables such image-bearing sheets to be satisfactorily endorsed using common writing implements. Examples of such uses include recording of criminal or scientific evidence, in displays, as passport photographs, and especially as an image-bearing sheet adapted for use as a greetings card wherein the backcoat is exposed to enable it to receive a written greeting and to adhere to a postage stamp with water activated adhesive.

EXAMPLES

The invention is now illustrated by reference to the following specific examples.

EXAMPLE 1

A coating composition was prepared as follows:

| | |
|---|---|
| SMA 17352A resin | 405 g |
| Carboset 525 | 39 g |
| Pergopak M3 | 42 g |
| Syloid 244 | 6.9 g |
| acetone | 2310 ml |
| D.A.A. | 255 ml |

This was obtained as a smooth composition by first mixing the fillers and some of the polymer in a small portion of the solvent, using a high shear mixer for ten mins. The remainder of the composition was added prior to use. The substrate was a laminate with surface layers of pearl film, one being treated to improve adhesion. The composition was bead coated directly onto the untreated pearl film, and dried and seasoned at 90°-100° C., to give a dry backcoat of 1-2 μm thickness.

On the other (treated) side of the substrate was prepared a receiver coat, the coating composition being a solution of the following in a 60/40 toluene/MEK solvent mixture, which was then applied, dried and cured in situ:

| | |
|---|---|
| Vylon 200 | 100 parts by weight |
| Tegomer HSi 2210 | 0.7 parts by weight |
| Cymel 303 | 1.4 parts by weight |
| Tinuvin 900 | 1.0 parts by weight |
| PTSA | 0.4 parts by weight |

(Vylon 200 is a polyester having a high dye-affinity, sold by Toyobo. Tegomer HSi 2210 is a bis-hydroxyalkyl polydimethylsiloxane sold by Th Goldschmidt, which is cross-linkable by the Cymel 303 in the acid conditions. Tinuvin 900 is a UV absorber sold by Ciba-Geigy.)

EXAMPLE 2

A further receiver was prepared with a different backcoat, using an aqueous coating composition as follows:

| | |
|---|---|
| Scripset 540 | 13.5 g |
| Carboset 525 | 1.3 g |
| water | 125 ml |
| 25% $NH_4OH$ | 5 ml |
| Pergopak M3 | 1.4 g |
| Syloid 244 | 0.23 g |

This was a more viscous composition than that of Example 1, and was coated onto a further portion of the pearl film laminate, this time by the faster slot fed reverse meter method.

A receiver coat was then added on the other side of the substrate, using the same coating composition as that used in Example 1.

Evaluation-printing

Each of the receivers of the two Examples was cut into standard sizes, and fed through a thermal transfer printer from a stack. Single sheets were fed from the stack in turn, and printed with a full colour image. No handling problems were experienced during printing. .

After printing samples of both receivers were examined for adhesion of the backcoat to the substrate. No evidence of lack of adhesion was found despite the substrate surface having been untreated.

Evaluation-writability and stampability

The prints were tested for writability using an HB pencil, a ball-point pen and a pen of aqueous ink. In each case no difficulty was experienced with either receiver.

To test whether such receivers could be used as postcards, postage stamps were moistened, and applied to the backcoats. When dry they could not readily be removed without damage.

Some commercial receivers having a standard cross-linked polymer backcoat were printed in the same manner, as a control. Writing could generally be effected with the pencil, but the aqueous ink agglomerated and ran off, that which dried first leaving no more than unreadable blobs. Similarly the ballpoint pen generally gave unsatisfactory results. These commercial receivers also failed the postage stamp test, the stamp as it dried becoming detached from the surface.

Evaluation-retransfer

The prints were stacked all facing the same way, such that the printed surface of one was lying against the backcoat of that overlying it. The stack was then left for several days under accelerated ageing conditions of 45°

C. and 85% relative humidity. Although time did not allow for the ageing to continue for the normal 15 days, the backcoat of the control showed substantial retransfer, being particularly noticeable with the magenta. Receivers of Examples 1 and 2, showed only slight discoloration on their backcoats to indicate retransfer.

The dyes used in the above tests were azopyridone yellow dyes, a mixture of CI Disperse Red 60 and a heterocyclic azo-isothiazole as the magenta, and a mixture of a diazothiophene blue and CI Solvent Blue 63 as the cyan.

EXAMPLES 3-7

A series of five further receivers was prepared, each having a crosslinked backcoat according to the present invention. These were compared with two receivers which were essentially repeats of Examples 1 and 2 (1' and 2'), a further receiver (X) having an alternative crosslinked backcoat but outside the invention, and with six other receivers (A-F) commercially available and identified as below.

The compositions of the prepared backcoats were as follows, where the quantities are given as parts by weight.

TABLE 1

| | Example | |
|---|---|---|
| | 1' | 2' |
| SMA 17352A | 82.2 | — |
| SCRIPSET 540 | — | 82.2 |
| CARBOSET 525 | 7.9 | 7.9 |
| PERGOPAK M3 | 8.5 | 8.5 |
| SYLOID 244 | 1.4 | 1.4 |

TABLE 2

| | Example | | | | |
|---|---|---|---|---|---|
| | 3 | 4 | 5 | 6 | 7 |
| SCRIPSET 540 | 73.2 | 66.7 | 61.3 | 65.0 | 62.5 |
| NACURE 2530 | 0.5 | 1.0 | 1.4 | 1.4 | 0.5 |
| CYMEL 303 | 8.2 | 10.0 | 11.5 | 7.3 | 11.7 |
| Polyethylene Glycol 400 | 8.2 | 10.0 | 11.5 | 12.2 | 11.7 |
| LiNO3 (anhydrous) | 0.1 | 0.1 | 0.1 | 0.1 | 0.1 |
| PERGOPAK M3 | 9.1 | 11.0 | 12.6 | 13.4 | 12.9 |
| SYLOID 244 | 0.7 | 1.2 | 1.6 | 0.6 | 0.6 |

Nacure 2530 is a blocked acid (PTSA) catalyst manufactured by King Industries Inc., Norwalk, Conn. USA.

Coating solvent for the above compositions was a 95/5 parts by volume mixture of acetone/diacetone alcohol. In compositions of both the above tables, total solids of approximately 8.0% w/v gave a solution with a viscosity suitable for roller or bead coating, whereas a total solids of approximately 16.0% w/v had a viscosity suitable for reverse gravure coating. These coating methods were variously used for the samples tested.

Turning to the comparative Examples, the receiver of Example X had a backcoat of the following composition, where the quantities are again given in parts by weight:

| | |
|---|---|
| VROH resin | 61.0 |
| CYMEL 303 | 21.3 |
| NACURE 2530 | 7.7 |
| GASIL EBN | 0.3 |
| SYLOID 244 | 1.3 |
| $LiNO_3.3H_2O$ | 2.3 |
| DIAKON MG102 | 6.1 |

(VROH is a solvent-soluble terpolymer of vinyl acetate, vinyl chloride and vinyl alcohol sold by Union Carbide, Gasil EBN and Syloid 244 are brands of silica particles sold by Crosfield and Grace respectively, and Diakon MG102 is a polymethylmethacrylate sold by ICI).

The comparative materials obtained commercially are coded in the tables below as follows:

Comp. A-Sony UPC-5010A, print paper for Mavigraph.
Comp. B-Mitsubishi print paper for S340 printer
Comp. C-Panasonic video print paper (VW-15100)
Comp. D-Fujix video print paper VP-S (VP-5100)
Comp. E-Hitachi video print paper VY-S (VY200)
Comp. F-PMI Express 2000, prt. no. 14943

Evaluation

The backcoats were evaluated using the following test procedures.

Writability was assessed by observing the behaviour of lines drawn on the test surface using an assortment of pens (ball-point, fibre-tip, solvent-based or aqueous inks) and pencils of varying hardness levels.

Smudging was assessed by allowing the lines created in the writability tests to dry (be absorbed) for approximately 30 s, then determining the degree of smudging when a finger tip was drawn across the line.

Stampability was assessed by moistening a stamp's adhesive with water and then sticking the stamp onto the test surface with adequate pressure to ensure intimate contact. The stamp was allowed to dry for 30 minutes at ambient conditions, and the ease of removal assessed. Ultimately, the stamp cohesion was determined by successful passage of a prepared postcard through the domestic postal system.

Dye retransfer properties of the backcoats were determined by first preparing a standard receiver sheet having a pure magenta print of optical density 2.0, using the magenta dye-sheet of Example 1. These prints and samples of the test backcoats were initially conditioned at 45° C. and 85% relative humidity for 10 minutes, and then assembled as a stack of A6 sheets, so that each backcoat sample contacted a standard magenta printed surface. A 500 kg weight was placed on the stack, and the assembly of sheets under the weight were maintained at 45° C. and 85% relative humidity for 15 days. At the end of the test period, the average C.I.E. L* a* and b* values for the area of transferred dye were measured. Similar measurements were made on fresh backcoated surfaces ($L^*_o a^*_o b^*_o$), and from these and the L* a* b* measured values, the Delta E value of the dye retransferred back-coat surface was determined using the formula:

$$\text{Delta } E=[(L^*-L^*_o)^2+(a^*-a^*_o)^2+(b^*-b^*_o)^2]^{\frac{1}{2}}$$

This calculated Delta E value was used to rate the back coat formulations as detailed in Table 3.

Rating scales

In each of the assessments, from writability to retransfer, the results were assessed on the following scales:

| |
|---|
| 1 - Very Good |
| 2 - Good |
| 3 - Satisfactory |
| 4 - Poor |
| 5 - Fail |

The results of the above tests are given in Table 3 below.

TABLE 3

| Example | Writability | Smudging | Stampability | Retransfer |
|---|---|---|---|---|
| 1' | 2 | 2 | 3 | 2 |
| 2' | 2 | 2 | 3 | 2 |
| 3 | 3 | 4 | 3 | 3 |
| 4 | 3 | 3 | 3 | 3 |
| 5 | 3 | 4 | 3 | 3 |
| 6 | 3 | 2 | 3 | 3 |
| 7 | 3 | 2 | 3 | 3 |
| X | 4 | 5 | 5 | 3 |
| Comp. A | 4 | 4 | 5 | 3 |
| Comp. B | 3/4 | 3/4 | 4 | 4 |
| Comp. C | 4 | 4 | 5 | 2 |
| Comp. D | 3 | 3 | 5 | 4 |
| Comp. E | 4 | 4 | 4 | 3 |
| Comp. F | 2 | 2 | 2 | 4 |

Backcoat composition in Examples 3–7 all employed Scripset 540 as the main maleic copolymer in order to minimise the variables. Substitution by other partially esterified styrene/maleic anhydride resins would be expected to give coatings of similar properties, though it may be necessary to adjust the coating solution solids content to allow for the different solution viscosities due to variations in copolymer molecular weights.

We claim:

1. A receiver sheet for thermal transfer printing comprising a substrate having a dye-receiving side and a backcoat on the other side, characterised in that the major component of the backcoat is a partially esterified styrene/maleic anhydride copolymer.

2. A receiver sheet as claimed in claim 1, characterised in that the copolymer is blended with 5–20% of a plasticising resin containing free hydroxyl or carboxylic acid groups.

3. A receiver sheet as claimed in claim 1 characterised in that the backcoat comprises a crosslinked polymer matrix which is the reaction product of (a) a polyfunctional crosslinking agent reactive with free hydroxyl and carboxylic acid groups in the presence of strong organic acid and (b) an excess of a co-reactant comprising said copolymer such that the crosslinked polymer matrix includes free carboxylic acid groups.

4. A receiver sheet as claimed in claim 1 or 3, characterised in that the backcoat contains micronised particulate filler in an amount of 5 to 50% by weight of the backcoat.

5. A receiver sheet as claimed in claim 1 or 3, characterised in that the backcoat contains 0.5 to 2% by weight of the backcoat of inert particles within the size range 2 to 10 μm in diameter.

6. A receiver sheet as claimed in claim 1 or 3, characterised in that the backcoat contains both inert particles within the size range 2 to 10 μm in diameter and micronised particulate fillers, the ratio of said inert fillers to said the micronised fillers being in the range 1:5 to 1:17.

7. A receiver sheet as claimed in claim 1 or 3, characterised in that the copolymer has a styrene/maleic ratio within the range 1:1 to 4:1, and an average molecular weight within the range 1,000–200,000.

8. A receiver sheet as claimed in claim 1 or 3, characterised in that the dye-receiving side has a thermally transferred image.

9. An image-bearing sheet as claimed in claim 8, characterised in that the sheet is adapted for use as a greetings card wherein the backcoat is exposed to enable it to receive a written greeting and to adhere to a postage stamp with water activated adhesive.

* * * * *